US005125530A

United States Patent [19]

Straub

[11] Patent Number: 5,125,530

[45] **Date of Patent: * Jun. 30, 1992**

[54] CLOSURE ASSEMBLY FOR CONTAINER

[75] Inventor: Roy Straub, Whittier, Calif.

[73] Assignee: Packaging Accessories Corporation, Encino, Calif.

[ * ] Notice: The portion of the term of this patent subsequent to Mar. 24, 2009 has been disclaimed.

[21] Appl. No.: 756,612

[22] Filed: Sep. 9, 1991

Related U.S. Application Data

[63] Continuation-in-part of Ser. No. 661,877, Feb. 27, 1991, Pat. No. 5,097,977.

[51] Int. Cl.[5] ..... B65D 39/00

[52] U.S. Cl. ..... 220/307; 220/306; 220/354

[58] Field of Search ..... 220/307, 306, 354, 315, 220/319, 320, 324, 352; 215/317, 320, 321

[56] References Cited

U.S. PATENT DOCUMENTS

| | | | |
|---|---|---|---|
| 484,779 | 10/1892 | Cone | 220/320 X |
| 2,828,789 | 4/1958 | Groendyk et al. . | |
| 2,885,108 | 5/1959 | Donoghue | 220/354 |
| 3,223,278 | 12/1965 | Allen . | |
| 4,105,121 | 8/1978 | Mascetti | 220/306 X |
| 4,180,179 | 12/1979 | Hoenig et al. . | |
| 4,296,871 | 10/1981 | Andersson . | |
| 4,312,459 | 1/1982 | Leach | 220/306 X |
| 4,356,930 | 11/1982 | Roper | 220/307 X |
| 4,397,404 | 8/1983 | Blanchette . | |
| 4,524,882 | 6/1985 | Buc | 220/306 |
| 4,577,776 | 3/1986 | Rayner et al. | 220/306 X |
| 4,619,373 | 10/1986 | Galer . | |
| 4,667,843 | 5/1987 | Galer | 220/307 X |
| 4,728,003 | 3/1988 | Davey | 220/306 X |
| 4,887,735 | 12/1989 | Dudzik | 220/307 |

*Primary Examiner*—Stephen Marcus
*Assistant Examiner*—Paul A. Schwarz
*Attorney, Agent, or Firm*—Poms, Smith, Lande & Rose

[57] ABSTRACT

A closure assembly for a container having a snap ring connected to the top of the container and a lid that may be easily attached to and later removed from the ring. The snap ring has a plurality of elongated engaging members with elongated grooves therein integrally formed at an annular inside surface thereof, and equally spaced circumferentially around the ring. The lid has an annular bead at an outer circumferential surface that engages the elongated grooves of the elongated engaging members when the lid is attached to the snap ring. Annular portions of the lid and ring also engage corresponding annular grooves of the lid and ring when the lid is attached to the top of the container, providing a secure seal. The lid may be easily removed from the snap ring by placing the end of a tool under the annular bead of the lid and prying the lid free of the container. Preferably the lid, snap ring and container are injection molded from plastic.

22 Claims, 6 Drawing Sheets

FIG. 7
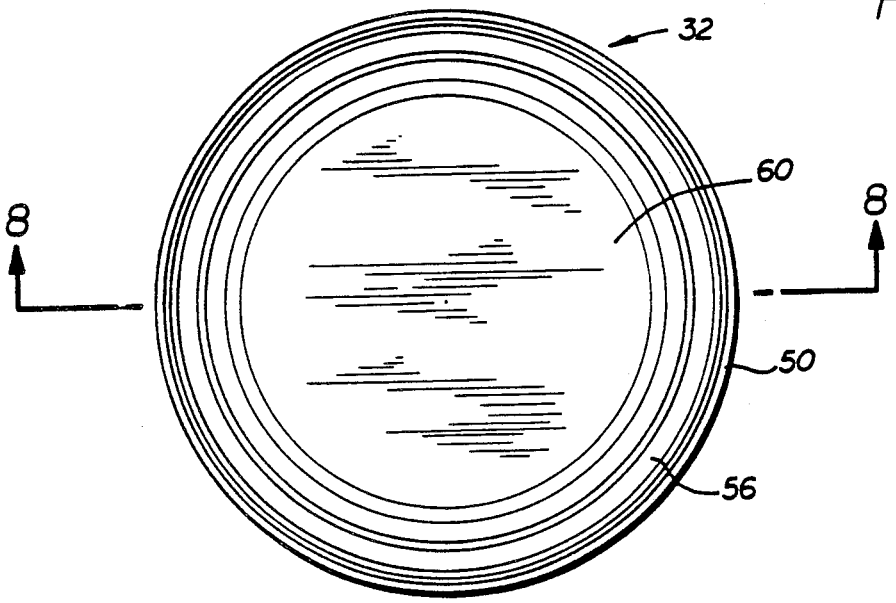
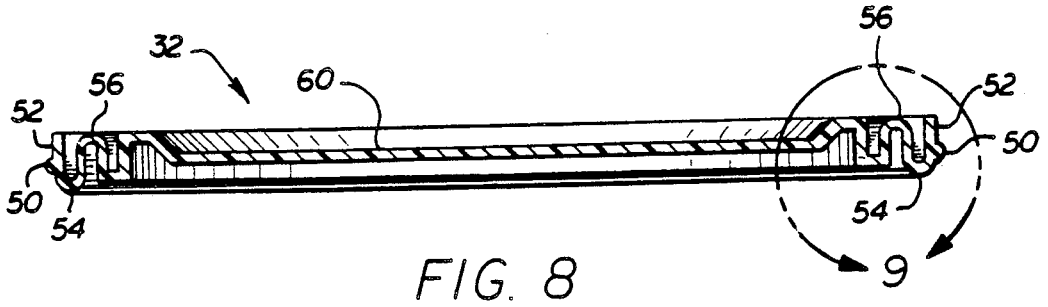
FIG. 8
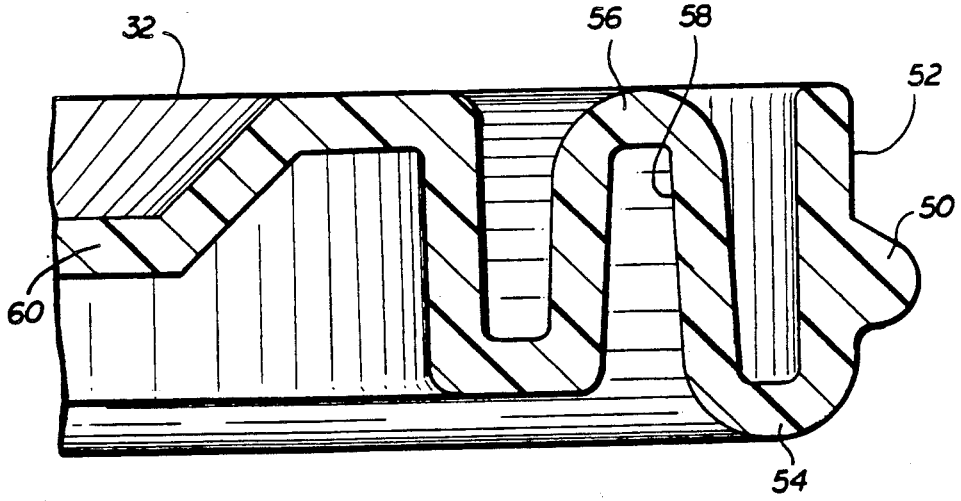
FIG. 9

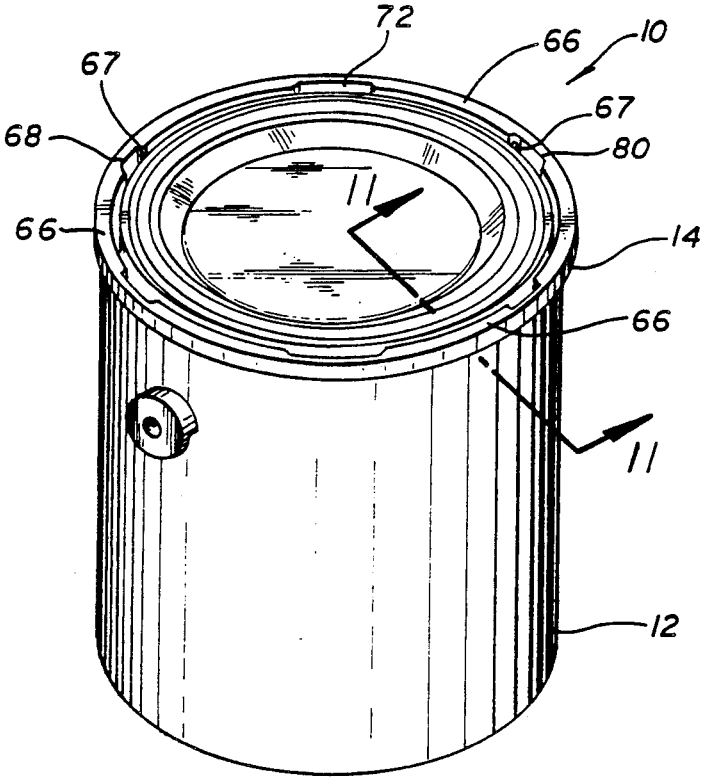
FIG. 10
FIG. 11
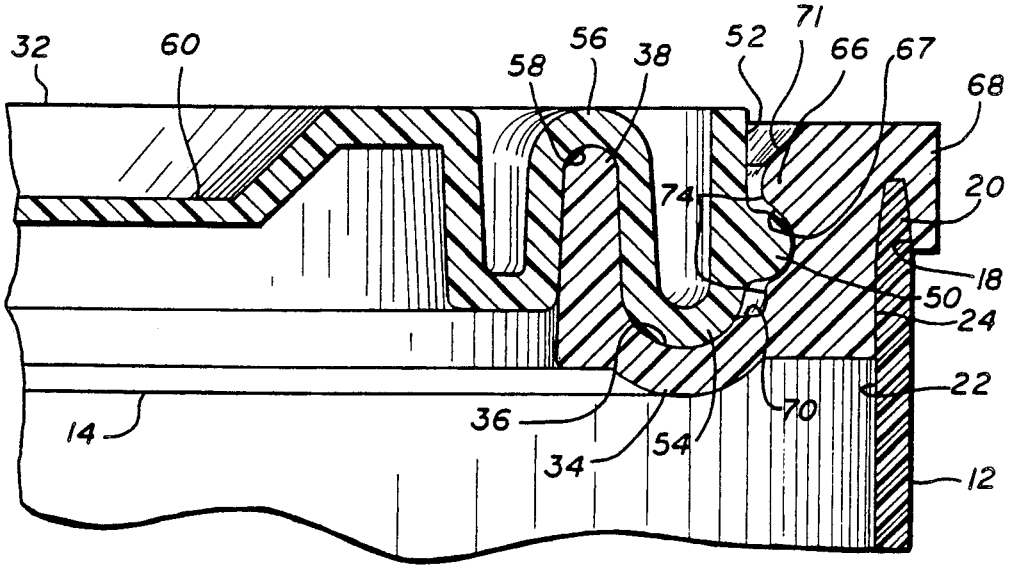

CLOSURE ASSEMBLY FOR CONTAINER

CROSS-REFERENCE TO RELATED APPLICATION

This application is a continuation-in-part of application, Ser. No. 07/661,877; filed Feb. 27, 1991, U.S. Pat. No. 5,097,977, and entitled "Closure Assembly For Container."

BACKGROUND OF THE INVENTION

The present invention relates generally to containers with snap-shut lids, and more particularly to an improved closure assembly for a container having a lid with an annular bead thereon that releasably engages a plurality of elongated engaging members located peripherally around a snap ring at the top of the container.

In the past, a variety of different means have been used to attach a lid to a container for the purpose of keeping the container shut and providing a seal between the lid and container. For example, closure means having a lid with a downwardly projecting portion that engages an annular channel in a rim of a container are disclosed in U.S. Pat. Nos. 2,828,789, issued to Groendyk, et al. on Apr. 1, 1958; 2,885,108, issued to Donoghue on May 5, 1959; and 4,180,179, issued to Hoenig, et al. on Dec. 25, 1979. Conversely, containers having upwardly projecting annular portions in rims of the containers that engage annular channels in lids are described in U.S. Pat. Nos. 3,223,278, issued to Allen on Dec. 14, 1965; 4,296,871, issued to Andersson on Oct. 27, 1981; and 4,887,735, issued to Dudzik on Dec. 19, 1989.

A paint can rim cover and lid combination is disclosed in U.S. Pat. No. 4,312,459, issued to Leach on Jan. 26, 1982. U.S. Pat. No. 4,397,404, issued to Blanchette on Aug. 9, 1983, shows a container having a lid and rim, each of which has an annular channel and annular projecting portion. The channel and projecting portion of the lid engage the channel and projecting portion of the rim sealing the lid to the container. U.S. Pat. Nos. 4,356,930, issued to Roper on Nov. 2, 1982; and 4,667,843, issued to Galer on May 26, 1987, disclose plastic containers. Finally, U.S. Pat. No. 4,619,373, issued to Galer on Oct. 28, 1986, describes a lid with an annular bead that engages an annular groove in the rim of the container.

SUMMARY OF THE INVENTION

Most of the closure means described above are complicated and expensive to manufacture. Also, difficulty is often encountered while attaching and removing the lid. Accordingly, there is a need for an improved closure assembly that is simple to use with a container.

It is an object of the invention to provide a closure assembly for use with a container that allows a user to easily attach a lid to the container, and later remove the lid when desired.

It is another object of this invention to provide a closure assembly for use with a container that provides a desirable seal between the lid and container.

It is still another object of this invention to provide a closure assembly for use with a container that is simple in design and economical to manufacture.

It is still another object of this invention to provide a molded plastic closure assembly for use with a molded plastic container.

These and other objects and advantages are attained by a closure assembly for a container having a snap ring connected to the top of the container and a lid that may be easily attached to and later removed from the ring. The snap ring has a plurality of elongated engaging members with elongated grooves therein integrally formed at an annular inside surface thereof, and equally spaced circumferentially around the ring. The lid has an annular bead at an outer circumferential surface that engages the elongated grooves of the elongated engaging members when the lid is attached to the snap ring.

Annular portions of the lid and ring also engage corresponding annular grooves of the lid and ring when the lid is attached to the top of the container, providing a secure seal. The lid may be easily removed from the snap ring by placing the end of a tool under the annular bead of the lid and prying the lid free of the container. Preferably, the lid, snap ring and container are injection molded from plastic.

The various features of the present invention will be best understood together with further objects and advantages by reference to the following description of the preferred embodiments taken in conjunction with the accompanying drawings.

BRIEF DESCRIPTION OF THE DRAWINGS

FIG. 7 is a top plan view of a lid used with the container;

FIG. 8 is a cross-sectional view taken in the direction of arrows 8—8 shown in FIG. 7;

FIG. 9 is an enlarged detailed view of the lid taken as indicated by arrows 9—9 in FIG. 8;

FIG. 10 is a perspective view of a container with another embodiment of the closure assembly which has a plurality of elongated engaging members;

FIG. 11 is a cross-sectional view taken in the direction of arrows 11—11 shown in FIG. 10.

DESCRIPTION OF THE PREFERRED EMBODIMENTS

The following specification taken in conjunction with the drawings sets forth the preferred embodiments of the present invention in such a manner that any person skilled in the art can make and use the invention. The embodiments of the invention disclosed herein are the best modes contemplated by the inventor for carrying out the invention in a commercial environment, although it should be understood that various modifications can be accomplished within the parameters of the present invention.

Figure 1:
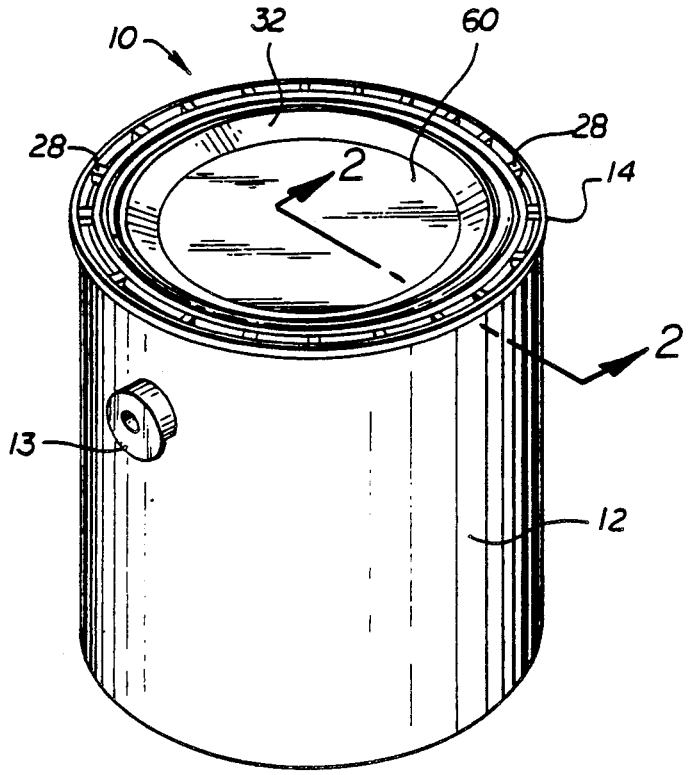
FIG. 1 is a perspective view of a container with a closure assembly which has a plurality of engaging members, illustrating the principles of the present invention.
Figure 2:
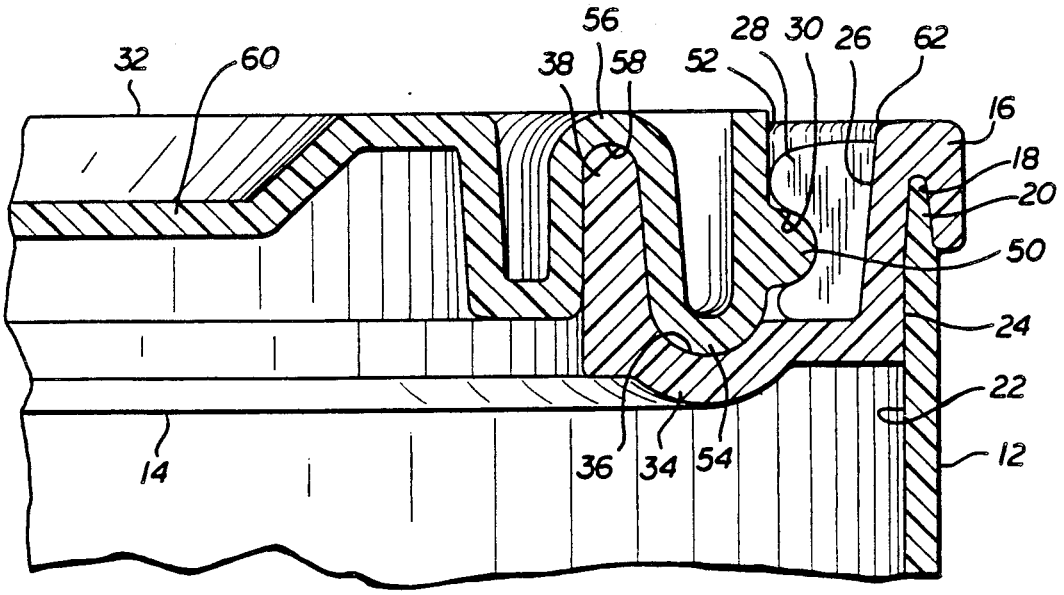
FIG. 2 is a cross-sectional view taken in the direction of arrows 2—2 shown in FIG. 1.
Figure 3:
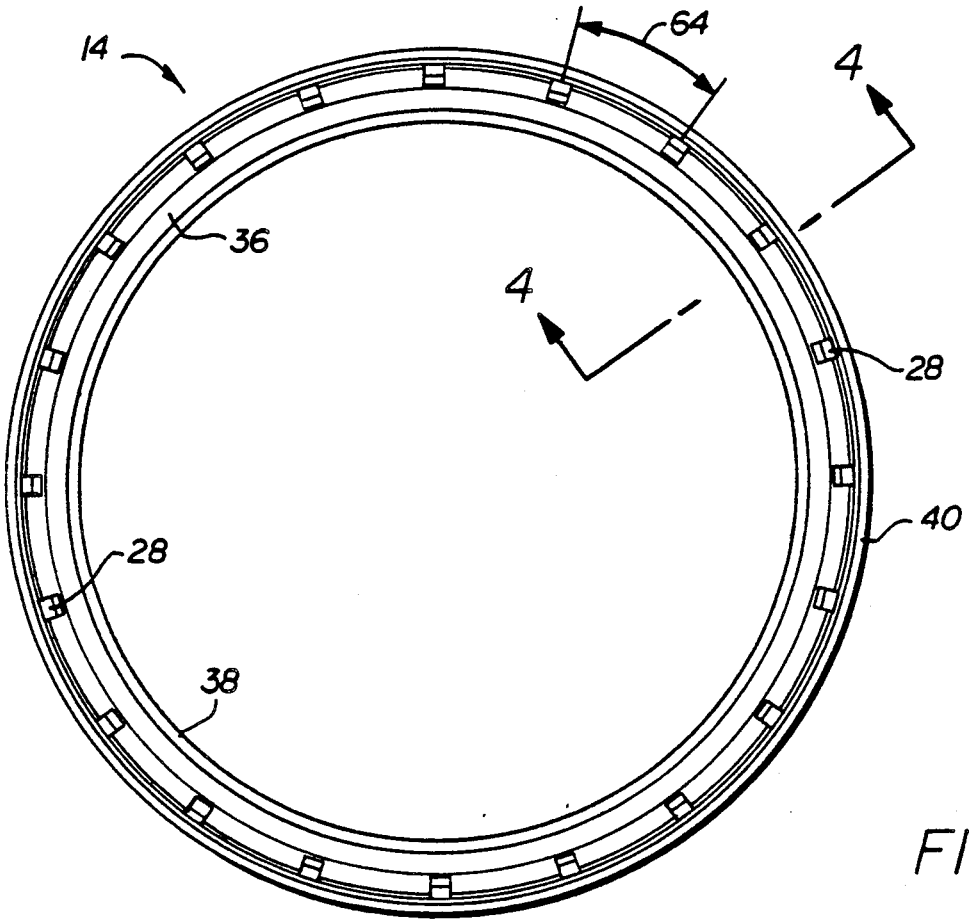
FIG. 3 is a top plan view of a snap ring with engaging members adapted to be mounted on the container.
Figure 4:
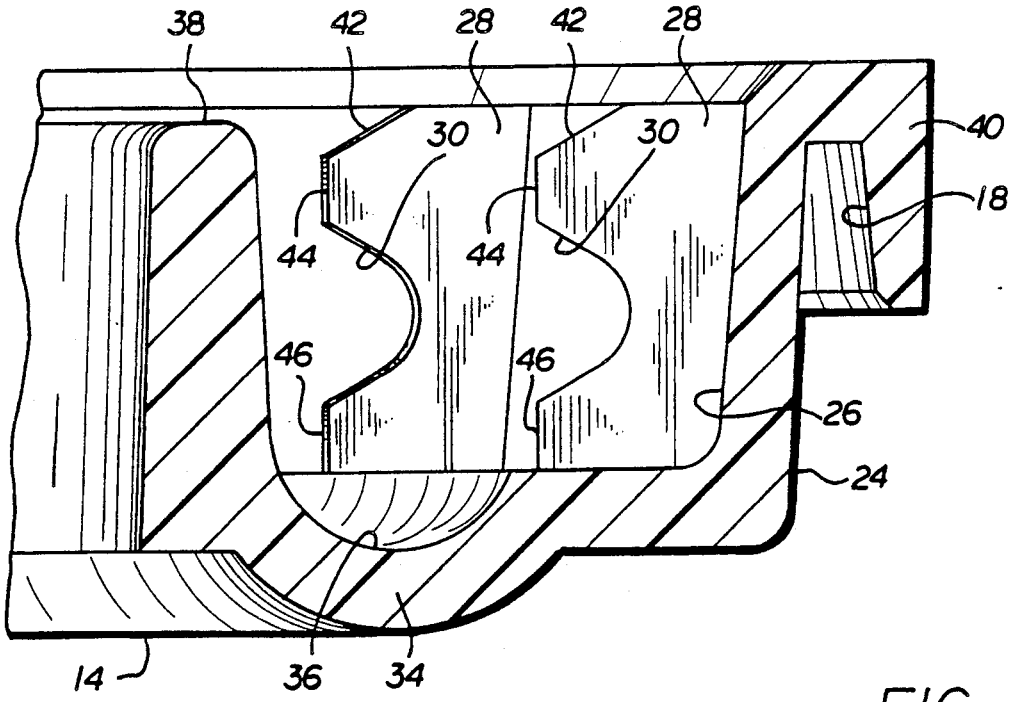
FIG. 4 is a cross-sectional view taken in the direction of arrows 4—4 shown in FIG. 3.

FIGS. 1 and 2 show a preferred embodiment of a closure assembly 10 for use with a container 12. The container 12 is preferably injection molded from a durable plastic material such as a high density polyethylene copolymer, HiD 9118, Pail Grade, sold by Chevron, or the like. However, any suitable material may be used for the container 12 such as metal, or the like. One advantage of using plastic material is that the container will not rust. The container 10 is preferably used as a paint container, but may be used for other purposes. In addition, the container 12 may have connections 13 at the outside thereof for connecting a carrying wire.

An annular snap ring 14 adapted to be mounted on the container 10 is shown in FIGS. 2 through 6. When mounted, as shown in FIG. 2, the snap ring 14 forms part of the closure assembly 10 and functions like a rim for the container 12. The snap ring 14 has an annular outer portion 16 with an annular channel 18 therein. As discussed below and shown in FIG. 2, an upper portion 20 of the container 12 engages annular channel 18 and is spin welded to outer portion 16 at channel 18 with inside surface 22 of the container 12 in contact with outside surface 24 of the ring 14. The snap ring 14 is preferably injection molded from durable plastic such as high density polyethylene copolymer (as described above), but any suitable material may be used for the ring 14, such as metal.

Referring again to FIG. 2, the snap ring 14 has an annular inside surface 26 with a plurality of engaging members 28 attached thereto, or integrally formed with the ring 14 during injection molding. Each engaging member 28 has a groove 30 therein. Any desirable number of engaging members 28 may be used to keep a lid 32 secured shut on top of the container 12, as is discussed below. Each adjacent pair of engaging members 28 are spaced a distance 64 (see FIG. 3) apart, and distance 64 may vary circumferentially around the snap ring 14 if desired. Preferably, about 20 engaging members 28 equally spaced circumferentially around the snap ring 14 are used for the closure assembly 10 (see FIG. 3). However, engaging members 28 may be unequally spaced around the snap ring 14 if desired. As shown in FIG. 2, the snap ring 14 has an annular downwardly extending portion 34 with an annular groove 36 therein, and an annular upwardly extending portion 38.

FIGS. 3 through 6 show another embodiment of the snap ring 14 having an outer portion 40 with ninety degree corners, and engaging members 28 with straight edges 42, 44 and 46 to better facilitate manufacturing of the ring 14. However, it is important to note that outer portions 16 and 40 and engaging members 28 may have any desirable shape, and the present invention is not limited by the shapes of these parts.

Figure 5:
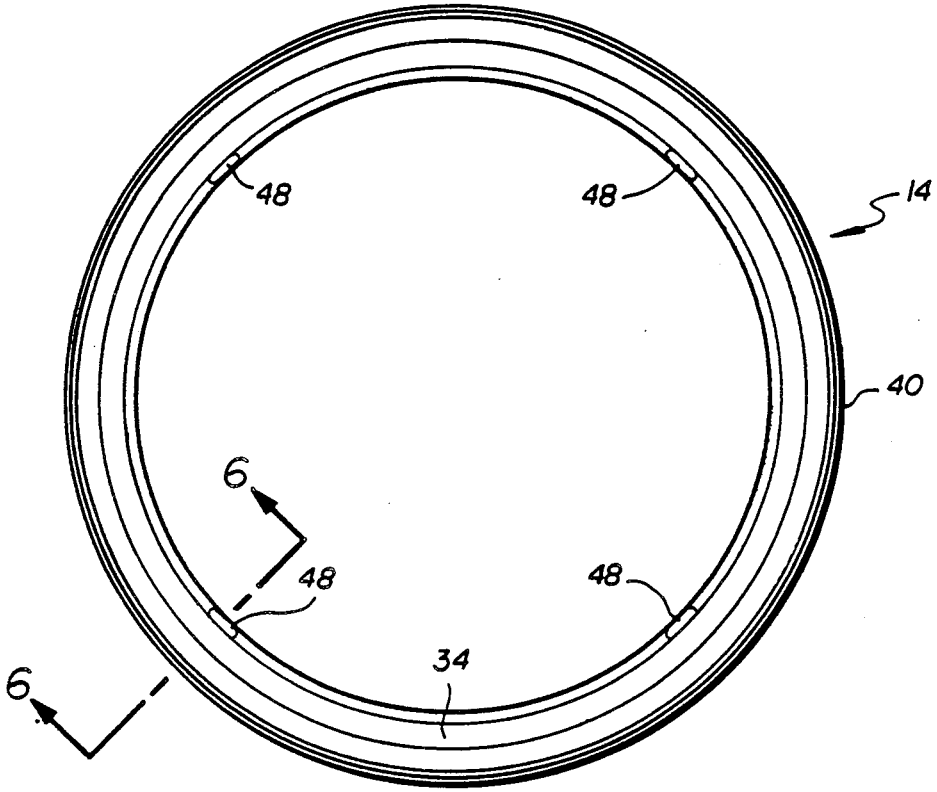
FIG. 5 is a bottom plan view of the snap ring.
Figure 6:
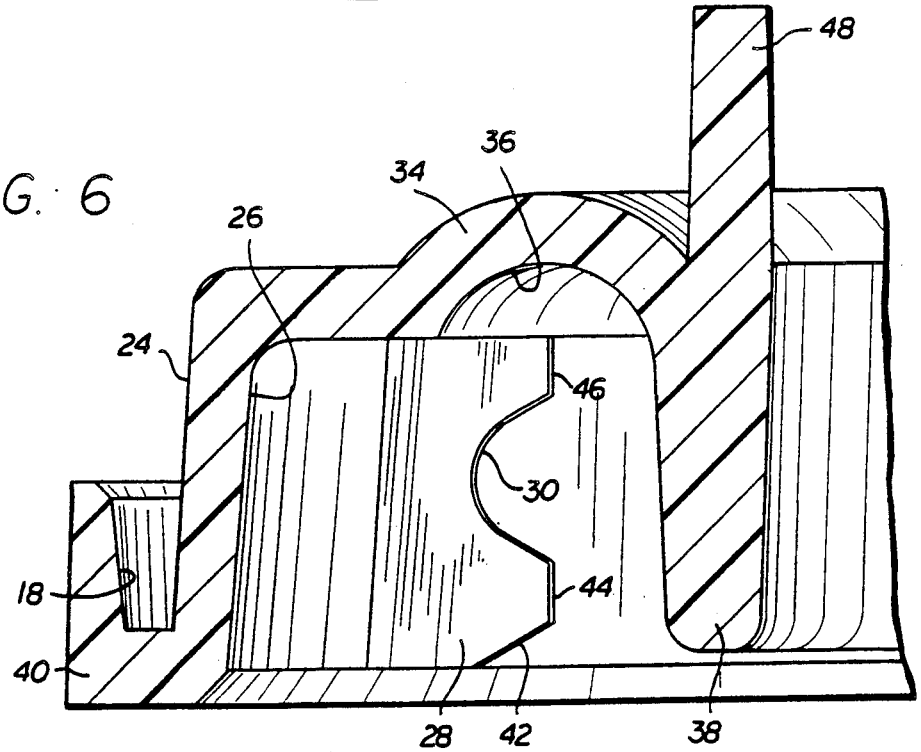
FIG. 6 is a cross-sectional view taken in the direction of arrows 6—6 shown in FIG. 5.

Referring to FIGS. 5 and 6, the snap ring 14 has downwardly extending tabs 48 (note that the snap ring 14 is shown upside down in these figures). Four tabs 48 are preferably used and spaced ninety degrees apart as shown in FIG. 5. The tabs 48 are used to position or hold the snap ring 14 in place when the ring 14 is spin welded or otherwise attached to upper portion 20 of the container 12 at channel 18.

The lid 32, which also forms part of the closure assembly 10, is shown in FIGS. 1, 2, 8 and 9. Preferably the lid 32 is injection molded from a durable plastic material such as high density polyethylene copolymer (as described above). However, any suitable material may be used, such as metal. The lid 32 has an annular bead 50 at an outer circumferential surface 52 thereof, an annular downwardly extending portion 54, and an annular upwardly extending portion 56 with an annular groove 58 therein. A round, flat portion 60 extends across the top of the lid 32.

As shown in FIG. 2, the lid 32 may be engaged or attached to the snap ring 14. The lid 32 may be attached by pushing downward on the lid 32 causing portion 38 of the ring 14 to engage groove 58 in portion 56 of the lid 32, portion 54 of the lid 32 to engage groove 36 in portion 34 of the ring 14, and annular bead 50 of the lid 32 to engage grooves 30 in the engaging members 28 of the ring 14. As a result, a secure seal is obtained between the lid 32 and snap ring 14 due to the engagement of the different parts of the lid 32 and ring 14, preventing paint or other liquid from leaking from the container 12.

The lid 32 may be easily removed from the snap ring 14 by placing the end of a screwdriver or other tool between the engaging members 28 and under the annular bead 50, and then using the top edge 62 of the snap ring 14 for leverage in order to pry the lid 32 free of the ring 14. As such, the distance 64 (see FIG. 3) between the engaging members 28 provides room for inserting a tool between the members 28, facilitating removal of the lid 32 from the snap ring 14.

Figure 12:
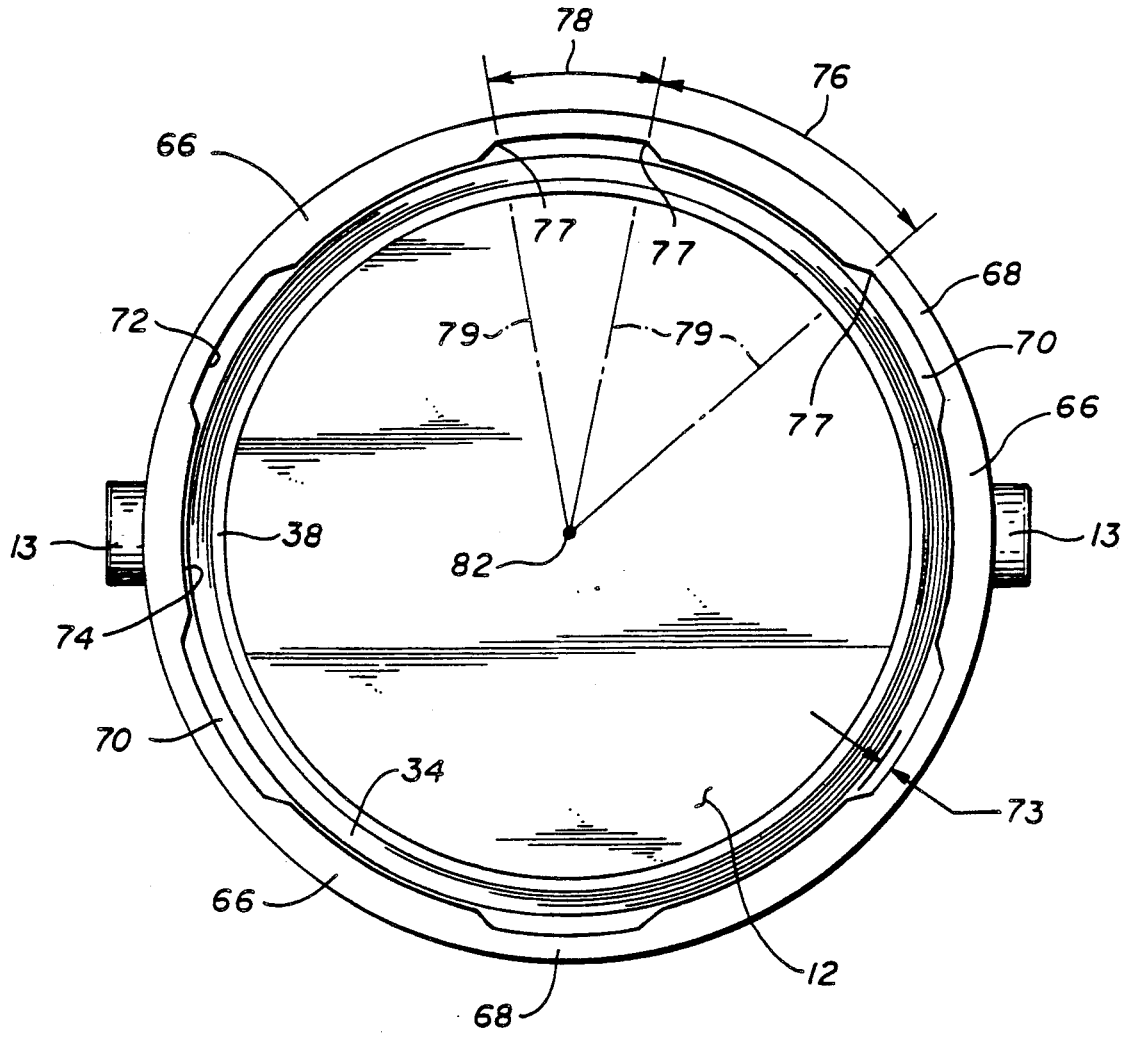
FIG. 12 is a top plan view of the container of FIG. 10 with the lid removed.

FIGS. 10 through 12 show still another embodiment of the snap ring 14 having a plurality of elongated engaging members 66. The elongated engaging members 66 are preferably integrally formed with the ring 14 during injection molding. Each member 66 has an elongated groove 67 therein.

As best illustrated in FIG. 12, the elongated engaging members 66 are integrally formed at and extend radially inward a distance 73 from an inside cylindrical surface 72 of an annular outer portion 68 of the snap ring 14, and preferably upward from an annular ledge 70 of the snap ring (see FIG. 11). Each of the elongated engaging members 66 extends a circumferential distance or angle 76 circumferentially around the snap ring 14. As shown in FIG. 12, angle 76 is defined by longitudinal planes 79 passing through ends 77 of each member 66 and a longitudinal cylindrical axis 82 of the container 12. Each elongated groove 67 extends the entire circumferential distance or angle 76 of its corresponding elongated engagement member 66, exiting at ends 77 of its member 66. The elongated engaging members 66 are separated by a circumferential distance or angle 78, as shown in FIG. 12, and have inside radially curved surfaces 74 (see FIGS. 11 and 12).

The snap ring 14 preferably is injection molded from high density polyethylene copolymer (as described above), but any suitable material may be used. As shown in FIG. 11, annular channel 18 is used to mount the ring 14 on the container 12. The elongated engaging members 66 each have a circumferential beveled edge 71.

Preferably, about 6 elongated engaging members equally spaced circumferentially around the snap ring 14 are used for the closure assembly 10 (see FIG. 12). However, the elongated engaging members 66 may be unequally spaced around the snap ring 14, if desired. For example, circumferential distance 78 may be varied around the circumference of the snap ring 14, if desired, or may remain constant.

Referring again to FIG. 11, the lid 32 is engaged to the snap ring 14 by pushing downward on the lid 32 until annular bead 50 is forced or slides past the beveled edge 70 of the elongated engaging members 66 and engages the elongated grooves 67. As such, beveled edges 71 facilitate attaching the lid 32 to the container 12.

The circumferential distance or angle 76 and distance 73 of the elongated engaging members are chosen to provide sufficient gripping action or support so that the lid 32 is held securely to the container. For example, if the snap ring 14 has an outer diameter of about $6\frac{5}{8}$ inches, circumferential distance 76 is preferably about 1.850 inches, and has a preferred range of from about 1.825 inches to about 1.875 inches. Also angle 76 is preferably about 27 degrees, and has a preferred range of from about 27 degrees to about 28 degrees. Likewise, distance 73 of the members 66 preferably is about 0.100 inches, and preferably has a range of from about 0.090 inches to about 0.110 inches. It is important to note that the circumferential distance or angle 76 and/or distance 73 for each member 66 may vary around the snap ring 14, or may remain constant, if desired.

The circumferential distance or angle 78 between members 66 is chosen so that a screwdriver or other tool may be used to remove the lid 32 from the container 12. Preferably, circumferential distance 78 is about 1.315 inches, and has a preferred range of from about 1.300 inches to about 1.330 inches. The distance 78 between the elongated engaging members 66 may vary around the snap ring 14, or may remain constant, if desired.

The lid 32 may be removed from the snap ring 14 by placing the end of a screwdriver or other tool in the space or distance 78 between the elongated engagement members 66 and under the annular bead 50, and then using top edge 80 of the snap ring 14 (see FIG. 10) for leverage in order to pry the lid 32 free of the ring. Edge 80 may be beveled, if desired.

Preferably, the container 12, snap ring 14 and lid 32 are injection molded from plastic material in order to provide a lightweight container 12 and closure assembly 10. However, other materials may be used if desired. The simple design of closure assembly 10 provides a product that is economical to manufacture using standard molding procedures. In addition, the container 12, snap ring 14 and lid 32 are used together and may be sold as a single product.

The above description describes the preferred embodiments of the present invention. However, persons of ordinary skill in the art are capable of numerous modifications once taught these principles. Accordingly, it will be understood by those skilled in the art that changes in form and details may be made to the above-described embodiments without departing from the spirit and scope of the invention.

I claim:

1. A closure assembly for use with a container, comprising:

a snap ring to be mounted on said container, said snap ring having a plurality of separate elongated engaging members circumferentially spaced and separated around said snap ring, each of said engaging members having an elongated engaging groove therein, each of said engaging members extending generally radially inwardly from an annular inside surface of said snap ring; and a lid having an annular bead at an outer circumferential surface thereof, said annular bead adapted to releasably engage said elongated engaging grooves of said elongated engaging members in order to releasably attach said lid to said snap ring.

2. The closure assembly of claim 1 wherein said snap ring has an annular downwardly extending portion with an annular groove therein and an upwardly extending annular portion located radially inward from said downwardly extending portion, and said lid has an annular downwardly extending portion and an annular upwardly extending portion with an annular groove therein, said downwardly extending portion of said lid releasably engaging said annular groove of said snap ring and said upwardly extending portion of said snap ring releasably engaging said annular groove of said lid in order to attach said lid to said snap ring and to provide a seal.

3. The closure assembly of claim 2 wherein said snap ring has about six equally spaced elongated engaging members.

4. The closure assembly of claim 2 wherein said elongated engaging members have beveled edges in order to facilitate engaging said lid to said snap ring.

5. A closure assembly for use with a container, comprising:

an annular snap ring to be mounted on said container;

a lid releasably engaged to said snap ring;

means located circumferentially around said lid for releasably engaging said snap ring; and a plurality of separate elongated means circumferentially spaced and separated around said snap ring for releasably engaging said lid and providing sufficient gripping action and support to securely hold said lid to said container, each of said plurality of separate elongated means extending generally radially inwardly from an annular inside surface of said snap ring.

6. The closure assembly of claim 5 wherein said means for releasably engaging said snap ring comprises an annular bead at an outer circumferential surface of said lid.

7. The closure assembly of claim 6 wherein said plurality of separate elongated means comprises a plurality of equally spaced elongated engaging members located circumferentially around said snap ring, each of said elongated engaging members having an elongated engaging groove therein, said annular bead adapted to releasably engage said elongated engaging grooves.

8. The closure assembly of claim 7 wherein said elongated engaging members have beveled edges in order to facilitate engagement of said annular bead to said elongated engaging grooves.

9. The closure assembly of claim 8 wherein said snap ring has an annular downwardly extending portion with an annular groove therein and an upwardly extending annular portion located radially inward from said downwardly extending portion, and said lid has an annular downwardly extending portion and an annular upwardly extending portion with an annular groove therein, said downwardly extending portion of said lid releasably engaging said annular groove of said snap ring and said upwardly extending portion of said snap ring releasably engaging said annular groove of said lid in order to attach said lid to said snap ring and to provide a seal.

10. The closure assembly of claim 9 wherein said snap ring has four downwardly extending tabs equally spaced circumferentially around said ring.

11. The closure assembly of claim 10 wherein said snap ring has an annular circumferential channel therein, said channel engaging said container.

12. The closure assembly of claim 7 wherein said snap ring, said lid and said container are made out of plastic.

13. The closure assembly of claim 1 wherein said snap ring, said lid and said container are made of plastic.

14. A closure assembly for use with a plastic container, comprising:

a plastic snap ring to be mounted on said container, said snap ring having a plurality of separate elongated engaging members circumferentially spaced and separated around said snap ring, each of said engaging members being integrally molded with said snap ring and having an engaging groove therein, each of said engaging members extending generally radially inwardly from an annular in side surface of said snap ring; and a plastic lid having an integrally molded annular bead at an outer circumferential surface thereof, said annular bead adapted to releasably engage said elongated engaging grooves of said elongated engaging members in order to releasably attach said lid to said snap ring and to form a seal between said snap ring and said lid.

15. The closure assembly of claim 14 wherein said snap ring has an annular downwardly extending portion with an annular groove therein and an upwardly extending annular portion located radially inward from said downwardly extending portion, and said lid has an annular downwardly extending portion and a annular upwardly extending portion with an annular groove therein, said downwardly extending portion of said lid releasably engaging said annular groove of said snap ring and said upwardly extending portion of said snap ring releasably engaging said annular groove of said lid in order to attach said lid to said snap ring and to provide a seal.

16. The closure assembly of claim 15 wherein each of said elongated engaging members extends a circumferential distance around said snap ring, said circumferential distance having a range of from about 1.825 inches to about 1.875 inches.

17. The closure assembly of claim 15 wherein each of said elongated engaging members extends circumferentially around said snap ring at an angle in the range of from about 27 degrees to about 28 degrees.

18. The closure assembly of claim 15 wherein said snap ring has said elongated engaging members equally spaced circumferentially around said ring with a circumferential distance separating said members, said circumferential distance having a range of from about 1.300 inches to about 1.330 inches.

19. A container comprising:

a generally cylindrical member having a bottom and an open top;

an annular snap ring mounted on said top of said cylindrical member;

a lid releasably engaged to said snap ring;

means located circumferentially around said lid for releasably engaging said snap ring; and a plurality of separate elongated means circumferentially spaced and separated around said snap ring for releasably engaging said lid and providing sufficient gripping action and support to securely hold said lid to said container, each of said plurality of separate elongated means extending generally radially inwardly from an annular inside surface of said snap ring.

20. The container of claim 19 wherein said means for releasably engaging said snap ring comprises an annular bead at a outer circumferential surface of said lid.

21. The container of claim 20 wherein said plurality of separate elongated means comprises a plurality of spaced elongated engaging members located circumferentially around said snap ring, each of said elongated engaging members having an elongated engaging groove therein.

22. The container of claim 21 wherein said cylindrical member, said snap ring and said lid are molded from plastic.

* * * * *